US005080147A

United States Patent [19]

Millet et al.

[11] Patent Number: 5,080,147

[45] Date of Patent: Jan. 14, 1992

[54] COCK FOR DRAWING-OFF

[75] Inventors: Pierre Millet, Neufchateau; Patrick Coffion, Bioncourt, both of France

[73] Assignee: Institut Francais des Boissons de la Brasserie Malterie, Vandoeuvre, France

[21] Appl. No.: 479,539

[22] Filed: Feb. 13, 1990

[30] Foreign Application Priority Data

Feb. 16, 1989 [FR] France ..... 89 02211

[51] Int. Cl.[5] ..... B65B 31/00

[52] U.S. Cl. ..... 141/39; 251/63.5; 141/147

[58] Field of Search ..... 141/39, 40, 266, 147, 141/6; 251/63.5

[56] References Cited

U.S. PATENT DOCUMENTS

| | | | |
|---|---|---|---|
| 2,492,873 | 12/1949 | Lamb | 251/63.5 |
| 2,671,591 | 3/1954 | Franz | 141/39 |
| 3,150,679 | 9/1964 | Roubeau et al. | 251/63.5 |
| 3,604,480 | 9/1971 | Reichert | 141/39 |
| 3,845,791 | 11/1974 | Friendship | 141/6 |
| 4,124,043 | 11/1978 | Nuguchi | 141/39 |
| 4,398,575 | 8/1983 | Brandon | 141/39 |
| 4,442,873 | 4/1984 | Yun | 141/39 |
| 4,487,237 | 12/1984 | Sick et al. | 141/39 |
| 4,815,692 | 3/1989 | Loiseau et al. | 251/63.5 |

*Primary Examiner*—Henry J. Recla
*Assistant Examiner*—Keith Kupferschmid
*Attorney, Agent, or Firm*—Sandler, Greenblum & Bernstein

[57] ABSTRACT

A cock for drawing-off carbonated liquid under pressure having a body having, in an internal area, a recess communicating with an opening under which is arranged a receptacle to be filled. In this recess is integrated a seating above which vertically extends a quill valve, which emerges from the body. An upper end of the quill valve penetrates into a carbonated liquid storage tank. The flow of carbonated liquid out of the storage tank is controlled via the quill valve, outside of the body and storage tank.

6 Claims, 3 Drawing Sheets

COCK FOR DRAWING-OFF

BACKGROUND OF THE INVENTION

1. Field of the Invention

The present invention relates to a cock for drawing-off carbonated liquid contained in a storage tank, which is maintained under pressure, for filling receptacles, such as bottles or the like. The invention will find application, particularly, in the drink industry with manufacturers and designers of machines used within the framework of this industry.

2. Description of Related Art

While drawing-off carbonated liquid from a tank, a number of precautions must be taken into consideration in order to guarantee the integrity and quality of the liquid, once the liquid has been distributed into individual receptacles. Specifically, during the filling operation, the carbonated liquid enters an important area of exchange with the surrounding environment. This surrounding environment, therefore, should be of an inert nature to avoid oxidation of the drink before consumption.

The drawing-off and storage of carbonated liquid is necessarily carried out under pressure. The pressure must be higher than the saturation pressure of the carbonated liquid, to avoid degasification of the liquid.

In view of the conditions set forth above, there has existed two prevailing methods of drawing-off carbonated liquids. The first consists of degassing the receptacle into which the liquid is to be drawn, and maintaining a pressure in the receptacle substantially equal to the pressure maintained in the storage tank of the drawing-off device. By means of a system of communicating vessels, the receptacle is then filled to the desired level. This is known as an isobaric drawing-off process.

During the isobaric drawing-off process, the receptacle is placed under pressure by a conduit extending inside the receptacle. After a pressure balance is reached, control means cause the opening of a drawing-off cock, allowing carbonated liquid to flow from the storage tank into the receptacle. During this filling process, gas contained in the bottle is either exhausted through a distinct channel or reinjected into the storage tank through a conduit having been used initially for placing the receptacle under pressure.

At the end of the filling process, the liquid contained in the bottle reaches the mouth of the gas exhaust conduit. This has a tendency to cause the pressure to rise in the receptacle, thereby stopping the flow of carbonated liquid into the receptacle. At that moment, a control means stops the flow of liquid, and the receptacle is again brought to atmospheric pressure before being withdrawn from the drawing-off cock and being directed towards a capping unit.

According to a second method, the pressure maintained at a vapor zone level of gas contained in the carbonated liquid storage tank is different from and higher than the pressure maintained in the receptacle. This is a phase-imbalance process. This process offers the advantage of reducing the filling time of a receptacle, but requires the use of level detection systems to detect the fill level in the receptacles. The principle of communicating vessels, as described above, is not available in this process.

Furthermore, these detection systems are presently considered to be unreliable and fairly expensive. This often leads carbonated drink manufacturers to use the principle of isobaric drawing-off.

The known drawing-off cocks of this type are usually comprised of a body having an external part capable of cooperating with the mouthpiece of the receptacle to be filled. Additionally, cocks of this type have an internal part located within the storage tank. This internal part comprises, more particularly, the control mechanisms to open or close the cock as well as means for placing the receptacle under pressure prior to the filling process. The external part of the body of the drawing-off cock comprises degassing means to bring the receptacle to atmospheric pressure at the end of the filling cycle and means for putting the receptacle under a vacuum or sweeping with a neutral gas at the beginning of the cycle.

As described above, the control mechanisms to open and close the cock as well as the means for placing the receptacle under pressure prior to filling, by bringing the receptacle's internal volume into contact with the gas contained in the storage tank, are housed inside the storage tank and, therefore, are immersed in the carbonated liquid.

These mechanisms are, in many cases, very complex and comprise, among other elements:

mechanical control means to open and close a valve;

flexible means for maintaining the valve in a closed position as long as the pressure balance in the tank and the receptacle has not equalized; and a conduit obturating system ensuring communication of the internal volume of the receptacle with the gas contained in the storage tank.

The food industry is required to adhere to very strict standards of hygiene to ensure clean working environments. Therefore, the drawing-off cocks require frequent cleaning. The more the mechanisms are in contact with the carbonated liquid, the more difficult it becomes to clean the drawing-off cocks and to eliminate all residues capable of later contaminating the consumable product.

Although the system of communicating vessels to control and stop the filling process of the receptacles is most often used, there are, nevertheless, a number of disadvantages inherent in the process. The slightest change in pressure between the storage tank and the receptacle during the filling process modifies the rate of filling.

Furthermore, there is a known drawing-off cock apparatus for carbonated liquids under pressure, where all the control mechanisms, the flow control, and the means for placing a receptacle under pressure, are integrated into the cylindrical body of the drawing-off cock located around a coaxially arranged flow conduit. Although this particular design of the drawing-off cock limits the mechanical parts in contact with the carbonated liquid, there are a number of leak-proof connections required during a filling cycle, making this drawing-off cock unreliable. Further, the complexity of the control mechanisms also tends to adversely affect the reliability of this known apparatus.

Furthermore, in this known apparatus, a bellows diaphragm connects the upper part of the liquid flow-out conduit with the internal upper part of the cylindrical body where the feed-in of carbonated liquid occurs. Such a bellows diaphragm raises the problem of dismantling and cleaning an innermost recesses to maintain the aforementioned standards of hygiene in the food industry.

Moreover, this type of drawing-off cock uses a ball-valve located at the lower end of a flow-out conduit as a filling end detection and liquid flow-out stop control means. Experience has proven that such systems are not operationally practical because of their lack of reliability and accuracy.

SUMMARY OF THE INVENTION

Therefore, an object of the present invention is to provide a carbonated liquid drawing-off cock where the mechanical elements in contact with the liquid are reduced to a minimum, thereby permitting easier cleaning. Another object of the invention is to guarantee a constant fill level of receptacles without requiring complex detection systems.

Specifically, the invention is directed to a cock for drawing-off carbonated liquid maintained under pressure. The drawing-off cock is provided with a body having a recess in an internal part communicating with an opening under which are arranged receptacles to be filled, such as bottles or the like. The drawing-off cock according to the present invention is further provided with:

(a) means for placing a receptacle under pressure;

(b) means for controlling the flow of carbonated liquid from a storage tank to the receptacle;

(c) means for detecting the fill level within the receptacle; and (d) means for placing the filled receptacle under atmospheric pressure.

The body of the drawing-off cock has, in a recess, a seating above which vertically extends a quill valve emerging from the body. The quill valve has an upper end which penetrates into the storage tank, forming a carbonated liquid flow conduit. The means for controlling the flow of carbonated liquid moves the quill valve, either lifting the valve from the seating thereby opening the valve, or lowering the valve onto the seating, thereby closing the valve. This means for controlling the flow are located outside the body and storage tank. The advantages obtained in this invention consist, mainly, in that the control valve for opening and closing the drawing-off cock also acts as the carbonated liquid flow-out conduit, and moves the valve without immersing mechanical elements into the storage tank.

BRIEF DESCRIPTION OF DRAWINGS

The invention is further explained below with reference to the drawings, in which.

DESCRIPTION OF PREFERRED EMBODIMENTS

Figure 1:
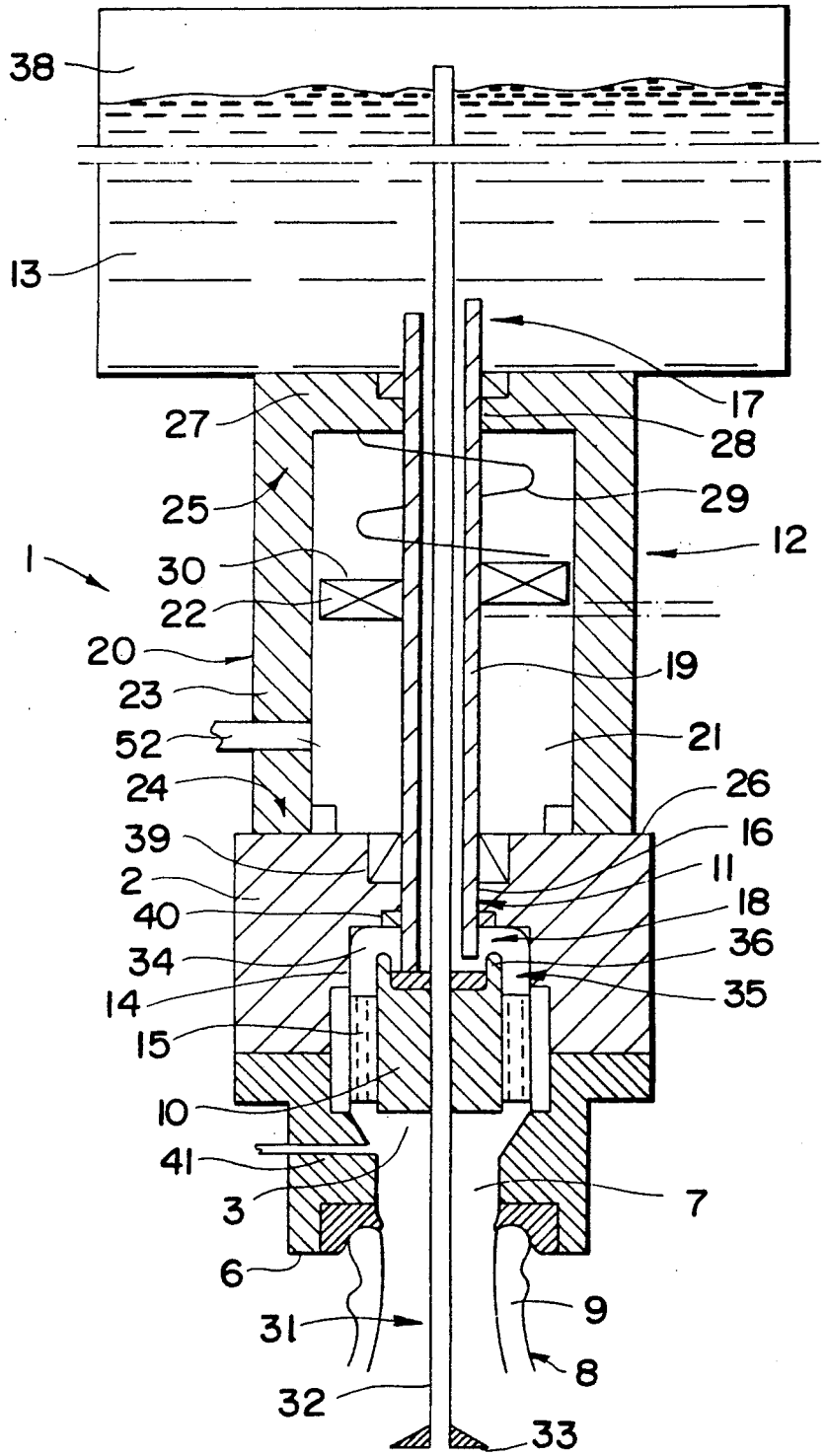
FIG. 1 is a schematic cross-sectional view of drawing-off cock according to one embodiment of the present invention.

The present invention relates to a cock for drawing-off carbonated liquid contained in a storage tank above the cock, for filling receptacles, such as bottles or the like, arranged below the drawing-off cock. As will become clear from the description below, the drawing-off cock according to the present invention is capable of being adapted to installations operating according to isobaric drawing-off principles or phase imbalance principles.

The drawing-off cock 1, as shown in FIG. 1, comprises a body 2 having, in an internal part thereof, a recess 3 ending outside body 2 at a lower face 6 through an opening 7. On lower face 6 of body 2, a receptacle 8, to be filled, is placed. Since the drawn-off liquid is preferably a carbonated liquid, it is absolutely necessary to maintain a pressure in the receptacle 8 during filling that is higher than the saturation pressure, i.e., the pressure necessary to maintain the liquid in a carbonated state. Therefore, it is necessary to ensure a certain tightness between the mouthpiece 9 of receptacle 8 and lower face 6 of body 2. Hence, the area around opening 7 is designed to match the morphology of mouthpiece 9 of receptacle 8 as closely as possible. Although this area corresponds, more particularly, to a bottle in the framework of FIG. 1, it is possible to modify lower face 6 of the body 2 to make such harmonious with the mouthpiece of receptacles of different shapes and sizes.

In recess 3 of the body 2 the seating 10 for valve 11 is arranged. Means for controlling the flow of liquid 12 acts upon valve 11 by raising or lowering the valve, thereby allowing or stopping the flow of carbonated liquid from storage tank 13. More particularly, seating 10 is integrated with wall 14 of recess 3 by means of spacers 15. Valve 11 vertically extends above seating 10 and is located in the axial extension of opening 7.

According to the present invention, valve 11 is comprised of a quill extending vertically above seating 10. The quill emerges from body 2 through a bore 16. Bore 16 has a diameter adjusted for receiving valve 11 and has set-backs 39, 40 capable of receiving seals. Upper end 17 of valve 11 penetrates into storage tank 13 and forms the carbonated liquid flow-out conduit.

By lifting valve 11 (as shown by the right side of the valve 11 in FIG. 1), lower edge 18 of valve 11 is lifted off the seating 10, allowing carbonated liquid from recess 3 of body 2 to flow through valve 11, siphon 34, and spacer 15 (as shown by the broken lines), into receptacle 8 through opening 7. When lower edge 18 of valve 11 rests on seating 10 (as shown by the left side of the valve 11 in FIG. 1), carbonated liquid is no longer capable of flowing through the conduit to the receptacle. The drawing-off cock is then in a closing position.

Figure 3:
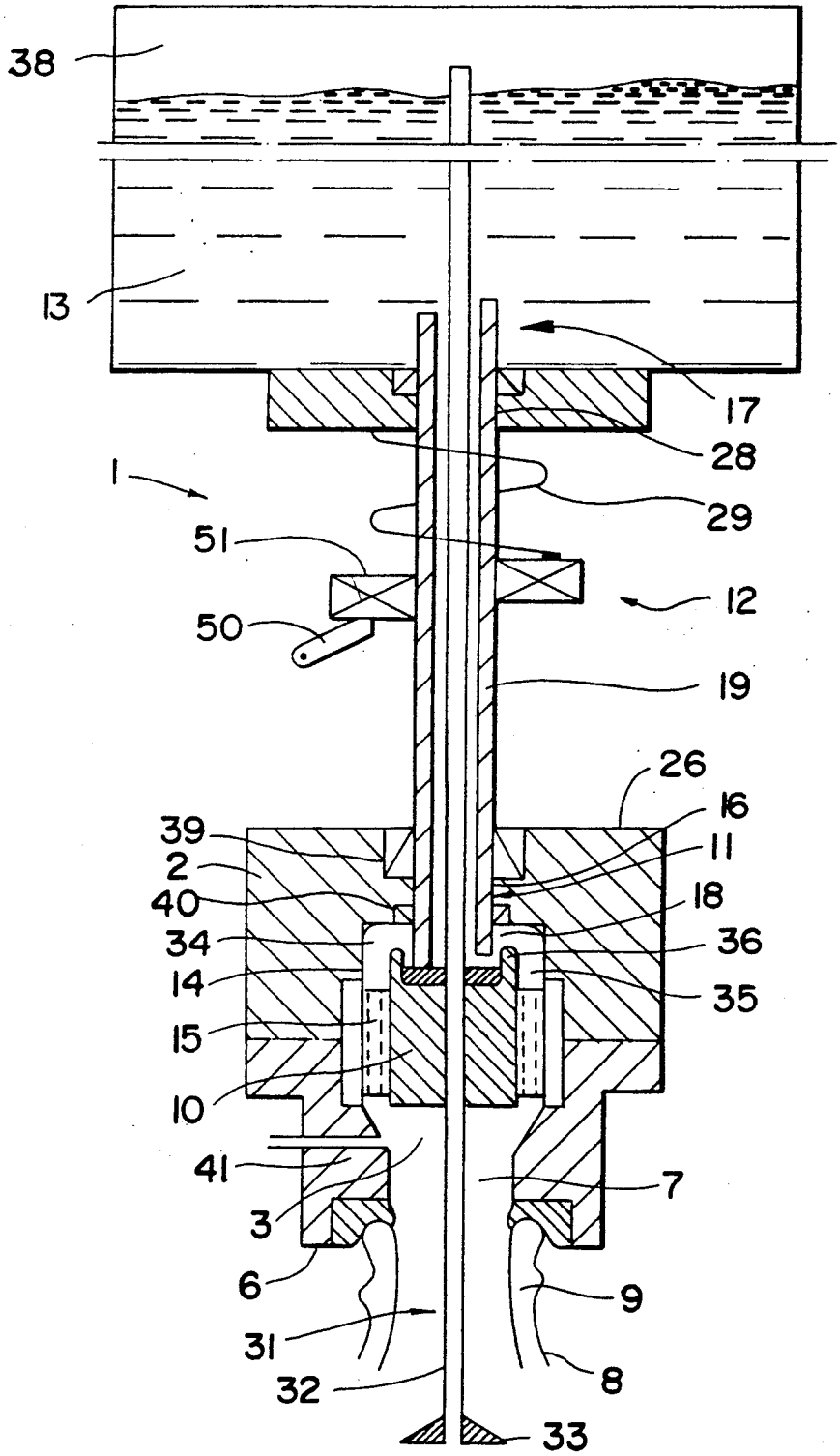
FIG. 3 is a schematic diagram of a third embodiment of the present invention.

Another advantage realized by the present invention is that the means 12 for controlling the flow of carbonated liquid by moving valve 11, is located outside the storage tank 13. More particularly, according to one embodiment, shown in FIG. 3, the flow control means 12 is a lever 50, capable of axially moving valve 11 by moving segment 19. Lever 50 is interposed between body 2 and storage tank 13. In this case, valve 11 is provided, on the periphery of segment 19, with a flange 51 capable of co-operating with lever 50. Lever 50 is controlled by a pneumatic-type driving means or the like, which is not shown herein.

The filling of receptacle 8 should be undertaken only after placing the receptacle under pressure. If this is not done, the carbonic gas in the carbonated liquid would dissipate during filling, destroying the carbonation, one of the main qualities the liquid.

For this purpose, valve 11 is subject to an outside pressure having a tendency to press valve 11, with a certain force, against seating 10. This pressure is compensated by the internal pressure of receptacle 8 at the beginning of the filling process allowing means for controlling the flow 12 and lever 50, as described above, to control the opening of the drawing-off cock 1 by axially moving valve 11.

According to another embodiment, shown more particularly in FIG. 1, means 12 for controlling flow, ensuring the opening and the closing of drawing-off cock 1, comprises a jack 20 located above the body 2. Jack 20 has, in an internal area 21, a piston 22 integrally connected with the valve 11 at segment 19. Valve 11 extends through jack 20 from top to bottom, so as to penetrate, at upper end 17, into the storage tank 13.

The cylindrical body 23 of jack 20 is obturated, at ends 24 and 25, by means of upper face 26 of body 2 and by flange 27 at the interface with storage tank 13. Flange 27 has, at its center, an opening 28 adjusted to the diameter of valve 11 in order to allow valve 11 to pass therethrough into tank 13.

Flexible means 29 co-operates with the internal face of flange 27 and upper face 30 of piston 22, thereby forcing valve 11 onto seating 10 with a force determined according to the pressure existing in receptacle 8 during filling. Flexible means 29 essentially form the means to control closing of drawing-off cock 1 at the end of the filling process.

Thus, after degassing receptacle 8 and placing receptacle 8 under pressure, the pressure exerted by the flexible means 29 on the valve 11 is substantially compensated by the pressure within receptacle 8. Drawing-off cock is thereafter opened by means of jack 20, including piston 22 which is movable upwardly for releasing the lower edge 18 of valve 11 from seating 10. Conduit 52 extends into internal area 21 of the jack 20, below piston 22.

The drawing-off cock 1 comprises, furthermore, means 31 for detecting that receptacle 8 is filled, to stop the flow of carbonated liquid from storage tank 13.

According to a first embodiment, as shown in FIG. 1, the means 31 for detecting is comprised of a conduit 32 penetrating into receptacle 8 through mouthpiece 9 over a length depending on the desired fill level. The operation of detecting means 31 is based on the principle of pressures within the communicating vessels as earlier described. Therefore, conduit 32 extends so as to pass through seating 10 and penetrate into storage tank 13 to a point above the liquid-gas interface in tank 13. Conduit 32 is coaxially located in quill valve 11 defining, with valve 11, an annular space through which carbonated liquid flows.

Furthermore, conduit 32 forms the means for placing the internal volume of the receptacle 8 under pressure by putting receptacle 8 into communication, at the beginning of the filling cycle, with the vapor environment 38 of the storage tank 13. During the filling cycle, conduit 32 allows the discharge of gases from receptacle 8 into storage tank 13.

At the end of the filling cycle, carbonated liquid reaches mouth 33 of conduit 32 in receptacle 8, flowing upwardly in conduit 32. At that moment, an over-pressure has a tendency to be generated above receptacle 8 in recess 3, which causes the flow of carbonated liquid from the storage tank 13 to stop. This is due to the un-priming of a siphon 34 located in the carbonated liquid flow-out circuit. In fact, seating 10 of the drawing-off cock 1 has, at periphery 35, a rim 36 extending substantially vertically defining an upper air-trap point. The central arrangement of seating 10 in recess 3 generates a wall effect, allowing laminar flow of carbonated liquid, avoiding turbulence and the production of foam.

As explained in the prior state of the art, in detecting the fill level of receptacle 8 according to the principle of pressures in the communicating vessels, certain disadvantages arise. For example, a change in pressure during the filling process in storage tank 13 or receptacle 8, or lack of tightness between the receptacle and lower face 6 make detection according to this principle difficult and unreliable.

Figure 2:
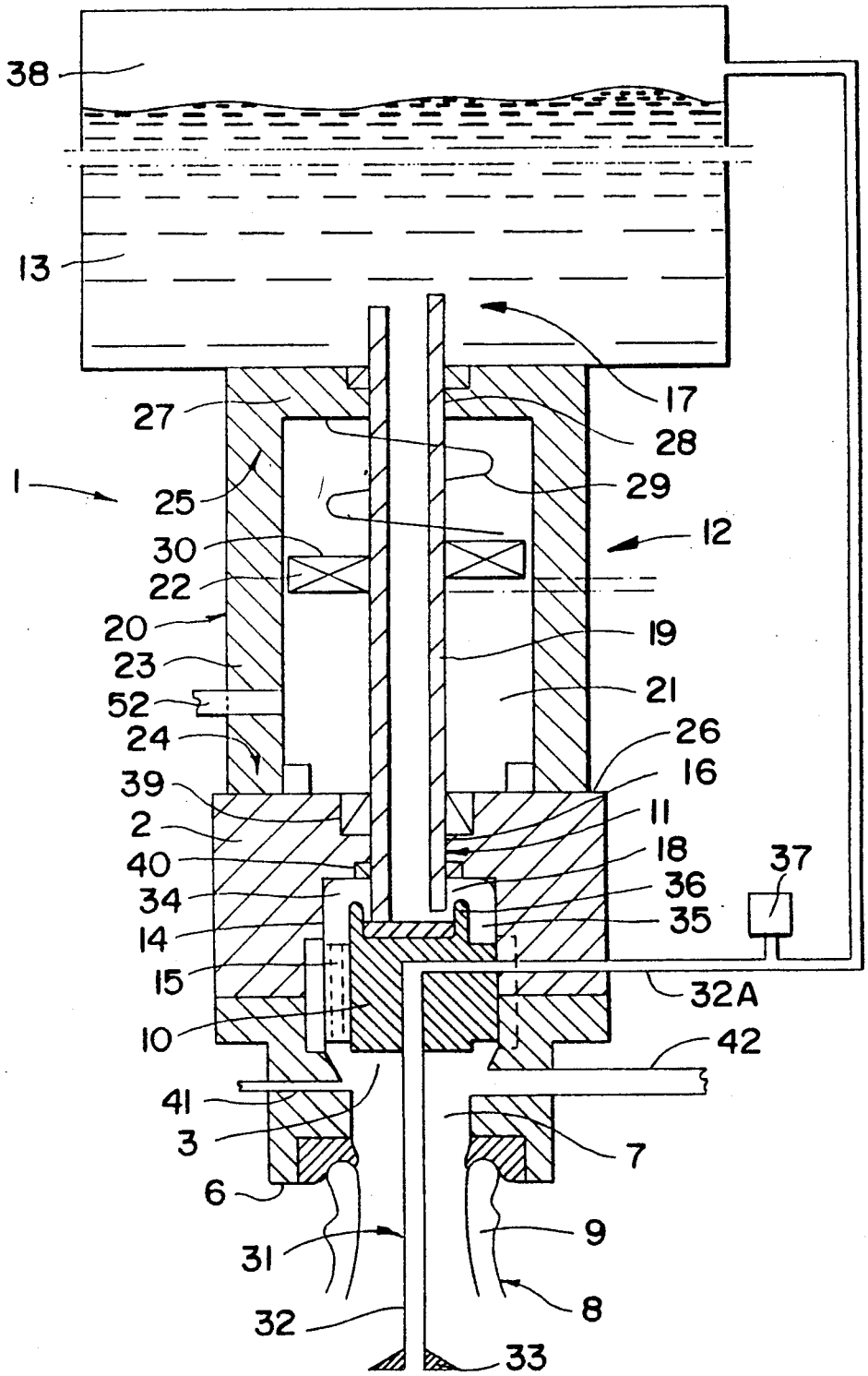
FIG. 2 is a schematic diagram of a second embodiment of the present invention.

In order to resolve such problems, in the embodiment shown in FIG. 2, a conduit 32A, instead of extending through valve 11, deviates therefrom, and emerges from the side of body 2. By this arrangement, a number of solutions to the aforementioned problems can be adopted.

One such solution consists of connecting conduit 32A, emerging from the side of body 2, with the vapor environment 38 of the storage tank 13. This results in a means for detecting the fill level of receptacles 8, operating according to the principle of pressures in the communicating vessels. Conduit 32A allows the exhaust of gases in receptacle 8 through a different circuit. However, the main advantage of conduit 32A is that it is possible to insert a pressure change detection means 37.

When the carbonated liquid reaches mouth 33 of the conduit 32A, a sudden change in pressure inside conduit 32A is created. This phenomenon is usually known as a pressure surge. By recording this instantaneous change in pressure, it is possible to activate means 12 for controlling flow, causing drawing-off cock 1 to close by lowering valve 11 onto seating 10.

In this respect, it should be noted that the instantaneous change in pressure is capable of being recorded in the whole vapor zone defined by recess 3, and vapor environment 38 or in recess 3 of body 2. Therefore, the invention is in no way limited to an embodiment where conduit 32A is used only for pressure change detection means 37. For example, conduit 32A can be used for placing receptacle 8 under pressure and/or exhausting gases contained in receptacle 8.

Means 31 for detection of the fill level of receptacle 8 eliminates the uncertain nature usually associated with this type of filling process. This system disregards possible changes in pressure between the receptacle 8 and the storage tank 13 during the filling process.

In view of the foregoing, the drawing-off cock 1 can be used in both isobaric and phase imbalance filling process systems. The combination of this advantage with the ease in cleaning the drawing-off cock according to the invention makes the invention particularly high-performing.

According to the configuration corresponding to conduit 32A, the means for placing receptacle 8 under pressure at the beginning of the cycle is conduit 42. Conduit 42 communicates with recess 3 of body 2 and is connected with either the vapor environment 38 of the storage tank 13 or a unit capable of delivering gas such as carbonic gas under pressure.

Finally, this drawing-off cock has means 41 for placing the receptacle under atmospheric pressure at the end of the filling process. Means 41 includes a conduit ending, on the one hand, in recess 3 of body 21 and, on the other hand, outside body 2 through an appropriate obturating system. Furthermore, although not shown, putting receptacle 8 under atmospheric pressure implies obturation of conduit 32 and/or conduit 42, which is used to place receptacle 8 under pressure at the beginning of the cycle.

We claim:

1. A drawing-off cock for drawing off carbonated liquid under pressure in a storage tank comprising:

a body having an internal recess adapted to receive a seating, said recess adapted to communicate with an opening under which a receptacle to be filled with said carbonated liquid is adapted to be placed;

means for facilitating placing said receptacle under pressure;

means for controlling flow of said carbonated liquid from said storage tank to said receptacle, said means for controlling flow being externally located of said storage tank and said body;

means for detecting a level of said carbonated liquid in said receptacle;

means for facilitating placing said receptacle filled with said carbonated liquid under atmospheric pressure; and a quill valve having an upper end extending into said storage tank and a lower end extending into said recess of said body, wherein said means for controlling flow is adapted to move said quill valve, said quill valve having a segment interposed between said seating and said storage tank, said means for controlling flow adapted to move said segment; and said means for controlling flow comprising a jack located above said body through which said quill valve passes, and said jack housing a piston affixed to said quill valve.

2. A drawing-off cock according to claim 1, wherein said jack includes a cylindrical body having a lower end obturated by an upper face of said body and an upper end closed by a flange, said flange having an opening through the center thereof adapted to permit the passage of said quill valve.

3. A drawing-off cock according to claim 2, wherein said means for controlling flow further comprises means for exerting axial pressure on said quill valve, located between said flange and said an upper face of said piston, said means for exerting axial pressure adapted to press said quill valve to said seating.

4. A drawing-off cock according to claim 1, wherein said means for detecting and said means for placing said receptacle under pressure is a conduit arranged coaxially within said quill valve, passing through said seating, said conduit having a lower end extending into said receptacle and an upper end extending into said storage tank.

5. A drawing-off cock according to claim 4, wherein said lower end of said conduit extends a predetermined depth into said receptacle.

6. A drawing-off cock according to claim 4, wherein said conduit extends into a vapor zone above said carbonated liquid in said storage tank.

* * * * *